US011976664B2

(12) United States Patent
Merritt et al.

(10) Patent No.: US 11,976,664 B2
(45) Date of Patent: May 7, 2024

(54) MOTOR AND BEARING COOLING PATHS

(71) Applicant: Hamilton Sundstrand Corporation, Charlotte, NC (US)

(72) Inventors: Brent J. Merritt, Southwick, MA (US); Craig M. Beers, Wethersfield, CT (US); John M. Beck, Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 344 days.

(21) Appl. No.: 16/530,475

(22) Filed: Aug. 2, 2019

(65) Prior Publication Data

US 2021/0033110 A1 Feb. 4, 2021

(51) Int. Cl.

| | |
|---|---|
| ***F04D 25/08*** | (2006.01) |
| ***F04D 25/06*** | (2006.01) |
| ***F04D 29/051*** | (2006.01) |
| ***F04D 29/58*** | (2006.01) |

(52) U.S. Cl.

CPC ..... *F04D 25/082* (2013.01); *F04D 25/0606* (2013.01); *F04D 29/051* (2013.01); *F04D 29/5806* (2013.01); *F04D 29/584* (2013.01)

(58) Field of Classification Search

CPC ..... F04D 25/0606; F04D 25/082; F04D 29/041–0413; F04D 29/051–0513; F04D 29/58–5806; F04D 29/582–584

USPC ..... 417/371

See application file for complete search history.

(56) References Cited

U.S. PATENT DOCUMENTS

| | | | | |
|---|---|---|---|---|
| 6,729,858 | B2 * | 5/2004 | Choi | F04D 17/122 417/365 |
| 8,529,192 | B2 | 9/2013 | Beers et al. | |
| 8,622,620 | B2 * | 1/2014 | Beers | F04D 25/082 384/115 |
| 8,931,304 | B2 * | 1/2015 | Beers | F04D 25/06 62/510 |
| 2006/0061222 | A1 * | 3/2006 | McAuliffe | F04D 25/06 310/60 R |
| 2012/0017617 | A1 | 1/2012 | Beers et al. | |
| 2012/0064815 | A1 * | 3/2012 | Beers | F04D 29/057 454/71 |
| 2013/0243619 | A1 * | 9/2013 | Beers | F04D 29/646 417/321 |
| 2014/0030070 | A1 * | 1/2014 | Beers | F04D 29/057 29/888.025 |
| 2014/0357176 | A1 * | 12/2014 | Beers | F25B 9/004 454/76 |

OTHER PUBLICATIONS

The Extended European Search Report for European Patent Application No. 19215843.4 dated Sep. 18, 2020.

The Partial European Search Report for European Patent Application No. 19215843.4 dated Jun. 18, 2020.

* cited by examiner

*Primary Examiner* — Alexander B Comley

(74) *Attorney, Agent, or Firm* — Carlson, Gaskey & Olds, P.C.

(57) ABSTRACT

A compressor includes a rotor configured to compress air and driven by a shaft. A motor is drives the shaft. A thrust bearing facilitates rotation of the shaft. The thrust bearing includes a thrust shaft and a thrust plate. The thrust shaft includes first and second orifices. A bearing cooling air inlet is in fluid communication with the first and second orifices.

7 Claims, 2 Drawing Sheets

MOTOR AND BEARING COOLING PATHS

BACKGROUND

This application relates to a compressor for an air machine.

Air machines include a turbine and a compressor. Partially compressed air is delivered to the compressor, and the compressor is driven to further compress this air. A motor drives the compressor. This compressed air is passed downstream to drive a turbine, with the turbine in turn helping to drive the compressor as the air expands across the turbine. This expanded air is then utilized for a downstream use, such as cabin air for an aircraft.

Air machines have a shaft which connects the compressor and the turbine. Bearings facilitate rotation of the shaft. Heat accumulates in the compressor as the air machine operates, and in particular, at the bearings and motor.

SUMMARY

A compressor according to an exemplary embodiment of this disclosure, among other possible things includes a rotor driven by a shaft which is configured to compress air. A motor drives the shaft, and a thrust bearing facilitates rotation of the shaft. The thrust bearing includes a thrust shaft and a thrust plate. The thrust shaft includes first and second orifices. A bearing cooling air inlet is in fluid communication with the first and second orifices.

In a further example of the foregoing, the first orifice is arranged generally parallel to an axis of the shaft.

In a further example of any of the foregoing, the second orifice is oriented generally perpendicular the first orifice.

In a further example of any of the foregoing, a ratio of a cross-sectional area of the first orifice to a cross-sectional area of the second orifice is between about 3.5 and 4.0.

In a further example of any of the foregoing, the bearing cooling air inlet is in fluid communication with an outlet of the compressor.

In a further example of any of the foregoing, at least one of the first and second orifices include an array of orifices.

In a further example of any of the foregoing, a passage is located between the motor and the shaft. The passage is in fluid communication with the second orifice.

In a further example of any of the foregoing, the passage has a cross-sectional area of between about 0.175 and 0.225 inches (4.45 and 5.72 mm).

In a further example of any of the foregoing, the compressor includes a motor rotor shaft. The motor rotor shaft includes a third orifice in fluid communication with the passage.

In a further example of any of the foregoing, a ratio of the cross-sectional area of the third orifice to a cross-sectional area of the passage is between about 3.00 and 3.50.

In a further example of any of the foregoing, the compressor includes a first journal bearing downstream from the first and second orifices and a second journal bearing upstream from the motor. The first and second orifices are configured to facilitate rotation of the shaft.

A compressor according to an exemplary embodiment of this disclosure, among other possible things includes a rotor that is configured to compress air and is driven by a drive shaft. The motor includes a motor rotor shaft. The motor rotor shaft includes an orifice in fluid communication with a passage between the motor and the drive shaft. A motor cooling air inlet is in fluid communication with the passage and the orifice.

In a further example of the foregoing, a thrust bearing facilitates rotation of the drive shaft. The thrust bearing includes a thrust shaft and a thrust plate. The thrust shaft includes first and second orifices.

In a further example of any of the foregoing, a ratio of a cross-sectional area of the first orifice to a cross-sectional area of the second orifice is between about 3.5 and 4.0.

In a further example of any of the foregoing, the compressor includes a bearing cooling air inlet. The bearing cooling air inlet is in fluid communication with the passage.

In a further example of any of the foregoing, the compressor includes a first journal bearing downstream from the motor and a second journal bearing upstream from the motor. The orifice is downstream from the second journal bearing. The first and second journal bearings are configured to facilitate rotation of the shaft.

In a further example of any of the foregoing, a ratio of the cross-sectional area of the orifice to a cross-sectional area of the passage is between about 3.00 and 3.50.

DETAILED DESCRIPTION

Figure 1:
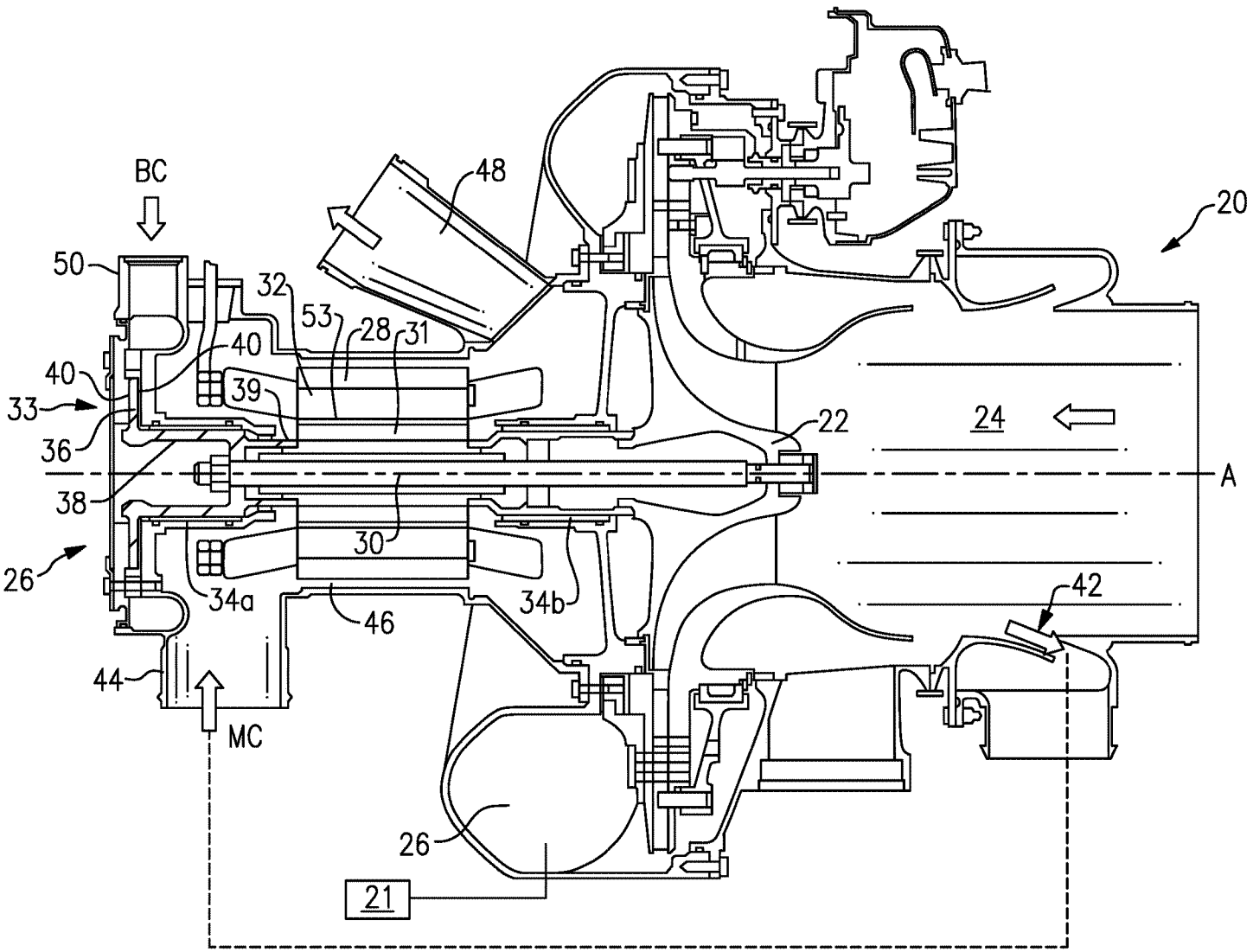
FIG. 1 shows a schematic cross-section of a compressor for an air machine.

FIG. 1 shows a compressor 20 that may be incorporated into a cabin air supply system 21 for supplying air to the cabin of an aircraft. A rotor 22 receives air to be compressed from an inlet 24, and compresses the air to a compressor outlet 26. A motor 28 drives a motor rotor shaft 39 and driveshaft 30 and to rotate the rotor 22. The motor 28 is an electric motor and includes a rotor 31 and a stator 32, as would be known in the art. In FIG. 1, air flows through the compressor from right to left.

A thrust bearing 33 and a journal bearings 34*a*, 34*b* facilitate rotation of the driveshaft 30. The thrust bearing 33 includes a thrust bearing disk 36 which is associated with a thrust shaft 38. The thrust shaft 38 connects to the motor rotor shaft 39. The thrust bearing disk 36 has thrust bearing surfaces 40.

Figure 2:
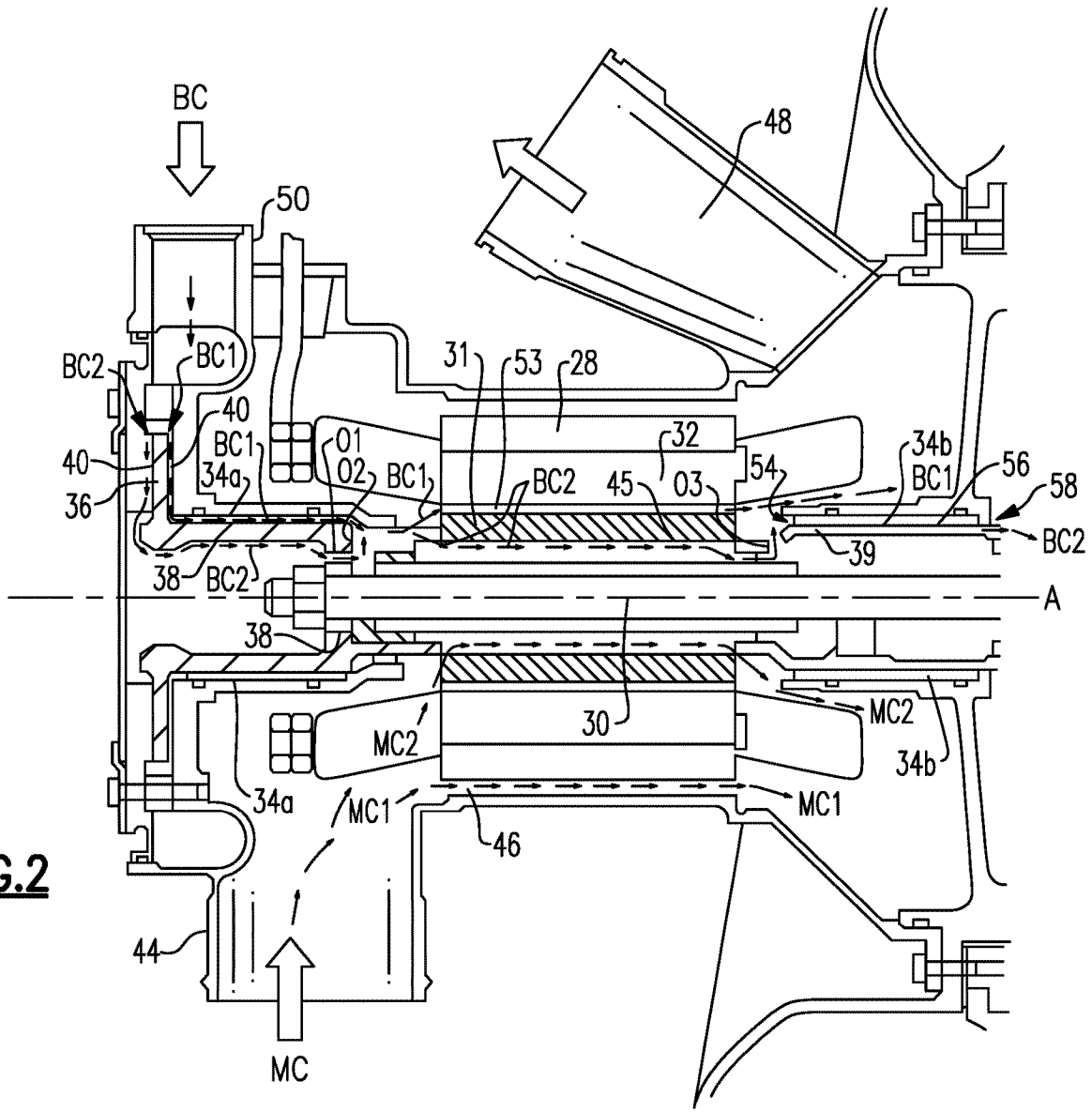
FIG. 2 shows a detail view of a portion of the cross-section of FIG. 1.

The motor 28, the thrust bearing 33, and the journal bearings 34*a*, 34*b* are cooled with cooling air. FIG. 2 schematically shows a detail view of the motor 28 and bearing 33, 34*a*, 34*b*.

A motor cooling stream MC is drawn from the compressor inlet 20 at 42 and provided to a motor cooling inlet 44. The motor cooling stream MC is split into two motor cooling streams MC1 and MC2. The first motor cooling stream MC1 passes along the inside diameter of the motor 28, via a passage 45 adjacent the shaft 30. The diameter of the passage 45 is related to the flowrate of first motor cooling stream MC1 that passes through the passage 45. The higher the cross-sectional area of the passage 45, the higher the flowrate of first cooling stream MC1, and more cooling provided to the motor 28 and/or shaft 30. Furthermore, the higher the flowrate of first cooling stream MC1, the more cooling air is available for the journal bearing 34*b*, as will be discussed in more detail below. In one example, the cross-sectional area of the passage 45 is between about 0.175 and 0.225 square inches (4.45 and 5.72 $mm^2$). In one example, the ratio of the diameter of the passage 45 to the diameter of the motor rotor 31 is between about 0.070 and 0.090. In one example, the ratio of the diameter of the motor rotor 31 to the diameter of the shaft 39 is between about 1.20 and 1.30.

The second motor cooling stream MC2 passes along an outer diameter of the motor stator 31 in a passage 46. The motor cooling streams MC1, MC2 ultimately exit the compressor 20 via a cooing air outlet 48. In one example, the outlet 48 ducts to ram (e.g., ambient) air.

A bearing cooling stream BC is drawn from downstream of the compressor outlet 26 and provided to a bearing cooling inlet 50. In one example, a heat exchanger (not shown) is upstream from the bearing cooling inlet 50 and downstream from the compressor outlet 26, and cools air in the the bearing cooling stream BC. The bearing cooling stream BC cools the thrust bearing 33 and the journal bearings 34*a*, 34*b*, and provides cooling to the motor 28, which will be explained in more detail below.

The bearing cooling stream BC is split into two bearing cooling streams BC1 and BC2, which pass along both sides of the thrust plate 36 at thrust surfaces 40 to cool the thrust bearing 33. The bearing cooling streams BC1 and BC2 continue along either side of the thrust shaft 38. The first bearing cooling stream BC1 passes alongside the journal bearing 34*a*. The first bearing cooling BC1 then passes through a passage 53 in between the motor rotor 31 and stator 32, providing additional cooling to the motor 28.

The second bearing cooling stream BC2 passes through orifices O1 and O2 formed in the thrust shaft 38. The orifice O1 is oriented generally parallel to an axis A of the shaft 30 while the orifice O2 is oriented generally perpendicular to an axis A of the shaft 30. That is, the orifices O1, O2 are oriented generally perpendicular to one another. The second bearing cooling stream BC2 then passes through the passage 45, adjacent the driveshaft 30, providing additional cooling to the motor 28 and/or driveshaft 30 along with the first motor cooling stream MC1.

The second bearing cooling stream BC2 passes through an orifice O3 formed in the motor rotor shaft 39 upstream of the motor 28 and then to the journal bearing 34*b*. In particular, the second bearing cooling stream BC2 passes through the journal bearing 34*b* inlet 54, the journal bearing 34*b* flow area 56, and the journal bearing 34*b* outlet 58. As discussed above, a larger cross-sectional area of the passage 45 allows for more cooling air to pass through the passage (e.g., a higher flowrate of cooling air). Accordingly, the larger the cross-sectional area of the passage 45, the more air is provided to the journal bearing 34*b*. The bearing cooling streams BC1, BC2 ultimately exit the compressor 20 via cooling air outlet 48.

The orifices O1, O2, O3 have an area and cross-sectional shape selected to maintain structural requirements of the thrust shaft 38 and motor rotor shaft 39, and provide cooling air to the bearings 33, 34*a*, 34*b* and motor 28 as discussed above. In general, the larger the area of the orifices O1, O2, O3, the higher the flowrate of cooling air passing through the orifices, the more cooling provided to the motor 28 and/or bearings 33, 34*a*, 34*b*. The orifices O1, O2, O3 can be generally circular in cross-sectional shape, or can have other shapes.

In one example, the orifice O1 is larger in cross-sectional area than the orifice O2. In this example, air passes through the orifice O1 at a higher flowrate than air passing through the orifice O2. In the example of FIG. 2, the second bearing cooling stream BC2 passes through the orifice O1 after passing along the thrust bearing 33, and the second bearing cooling stream BC2 is cool relative to the first bearing cooling stream BC1, which has passed along and accumulated heat from both the thrust bearing 33 and the journal bearing 34*a*. Therefore, a larger orifice O1 allows for more cool air from the second bearing cooling stream BC2 to cool downstream components such as the motor 28, as discussed above.

In a more particular example, the ratio of the cross-sectional area of the orifice O1 to that of the orifice O2 is between about 3.5 and 4.0.

In one example, the ratio of the cross-sectional area of orifice O3 to the cross-sectional area of the passage 45 is between about 3.00 and 3.50.

In one example, the orifice O1 has a cross-sectional area of 0.333 inches (8.45 mm). In another example, the orifice O2 has a cross-sectional area of 0.088 inches (2.24 mm). In another example, the orifice O3 has a cross-sectional area of 15.80 mm.

In some examples, one or more of the orifices O1, O2, O3 comprise arrays of orifices, and the sum total of the cross-sectional areas of each orifice in the array of orifices corresponds to the total cross-sectional area of the orifice. For instance, 1-20 orifices can be used. In a particular example, the orifice O1 includes 12 orifices. In another particular example, the orifice O2 includes 5 orifices. In another particular example, the orifice O3 includes 12 orifices.

In general, the orifices O1, O2, O3 together with the passage 45 provide improved cooling to the motor 28 and bearings 33, 34*a*, 34*b*, improving the lifetime and reliability of the motor 28 and bearing 33, 34*a*, 34*b*. This in turn allows for improved performance of the compressor 20.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a rotor driven by a drive shaft and configured to compress air; and a motor for driving the drive shaft, the motor including a motor rotor shaft, wherein the motor rotor shaft includes a first orifice in fluid communication with a passage between the motor and the drive shaft; a motor cooling air inlet, wherein the motor cooling air inlet is in fluid communication with the passage and the first orifice; and a thrust bearing for facilitating rotation of the drive shaft, the thrust bearing including a thrust shaft and a thrust plate, the thrust shaft extending from the thrust plate towards the motor, and including second and third orifices between the thrust plate and the motor, wherein the second orifice is arranged upstream from the third orifice, and wherein a ratio of the cross-sectional area of the first orifice to a cross-sectional area of the passage is between 3.00 and 3.50.

2. The compressor of claim 1, wherein a ratio of a cross-sectional area of the second orifice to a cross-sectional area of the third orifice is between 3.5 and 4.0.

3. The compressor of claim 1, further comprising a bearing cooling air inlet, wherein the bearing cooling air inlet is in fluid communication with the passage.

4. The compressor of claim 1, further comprising a first journal bearing downstream from the motor and a second journal bearing upstream from the motor, wherein the first orifice is downstream from the second journal bearing, and wherein the first and second journal bearings are configured to facilitate rotation of the drive shaft.

5. The compressor of claim 1, wherein the second orifice is arranged generally parallel to an axis of the drive shaft.

6. The compressor of claim 1, wherein the third orifice is arranged generally perpendicular to the second orifice.

7. The compressor of claim 1, wherein the passage has a cross-sectional area of between 0.175 and 0.225 inches.

* * * * *